US009440716B1

(12) United States Patent
Arditi

(10) Patent No.: US 9,440,716 B1
(45) **Date of Patent: *Sep. 13, 2016**

(54) ENHANCED SYSTEM AND METHOD FOR AUTOMATICALLY DEPLOYING BOAT FENDERS

(71) Applicant: Shmuel Sam Arditi, Discovery Bay, CA (US)

(72) Inventor: Shmuel Sam Arditi, Discovery Bay, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/929,369

(22) Filed: Nov. 1, 2015

Related U.S. Application Data

(60) Provisional application No. 62/153,193, filed on Apr. 27, 2015.

(51) Int. Cl.
*B63B 59/02* (2006.01)

(52) U.S. Cl.
CPC ..... *B63B 59/02* (2013.01)

(58) Field of Classification Search
CPC ... B63B 59/02; B63B 2059/025; E02B 3/26; E02B 17/003; B66D 1/46; B66D 1/48; B66D 1/50; B66D 1/52; B66D 1/56; B66D 1/58; B66D 3/20; B66D 3/24; B66D 3/26
USPC ..... 114/218, 219, 120, 364; 297/107, 109, 297/118, 140; 405/212, 213, 214, 215
See application file for complete search history.

(56) References Cited

U.S. PATENT DOCUMENTS

| | | | | |
|---|---|---|---|---|
| 1,505,785 | A | 8/1924 | Jiengiel | |
| 4,817,552 | A | 4/1989 | Poldervaart | |
| 6,758,155 | B1 | 7/2004 | Nicholas | |
| 7,007,622 | B1 | 3/2006 | Clark | |
| 8,136,467 | B2 | 3/2012 | Powell et al. | |
| 8,726,824 | B2 * | 5/2014 | Jarke | B63H 9/10 114/102.1 |
| 9,038,556 | B2 | 5/2015 | Ulgen | |
| 2005/0242332 | A1 * | 11/2005 | Ueki | B66D 1/52 254/277 |
| 2008/0023681 | A1 * | 1/2008 | Cunningham | B66D 3/20 254/362 |
| 2009/0266283 | A1 * | 10/2009 | Wrage | B63H 9/0685 114/102.12 |
| 2014/0257631 | A1 * | 9/2014 | Heravi | B66D 1/42 701/36 |

* cited by examiner

*Primary Examiner* — Anthony Wiest
(74) *Attorney, Agent, or Firm* — Galvin Patent Law LLC; Brian R. Galvin

(57) ABSTRACT

A system for automatically deploying boat fenders, comprising a basket for lowering fenders, said fender attached to a line, said line coupled to a winch, said winch coupled to a motor, and said motor controlled by a controller, said controller being activated via a wire line or wireless control signals, wherein a computing device with a software is used to control one or more controllers of the baskets.

9 Claims, 13 Drawing Sheets

1100

ENHANCED SYSTEM AND METHOD FOR AUTOMATICALLY DEPLOYING BOAT FENDERS

CROSS-REFERENCE TO RELATED APPLICATIONS

This application claims priority to U.S. provisional patent application Ser. No. 62/153,193, titled, "Enhanced System and Method for Automatically Deploying Boat Fenders", which was filed on Apr. 27, 2015, the entire specification of which is incorporated herein by reference.

BACKGROUND OF THE INVENTION

1. Field of the Art

The disclosure relates to the field of boating, and more particularly to the field of deploying fenders for use in docking a boat.

2. Discussion of the State of the Art

Boating, in a motorized or sail-powered craft, is both a popular recreation and also the foundation of the seafood industry. The operator of the craft must be able to navigate it safely and also to dock it safely, whether at a stationary, land-based dock, next to another boat, or at some other, similar large adjacent object, herein throughout referred to as a "dock." In cases of stormy weather or large waves, deploying and positioning the boat fenders to keep the boat from bashing into a dock can be tricky and even dangerous.

What is needed is a system and method that enables a boat operator to safely and conveniently deploy boat fenders when needed. What is additionally needed is a way to extend and retract boat fender using a motor-driven mechanism, for added safety and convenience. Further needed is a system and method enabling a user to control these fenders from a mobile computing device, such as a smartphone or tablet. Additionally needed, in some cases, is a system and method to deploy the fenders automatically based on a global positioning system (GPS) location of the boat on previous visits and on the fact that its trajectory leads the boat to a dock.

SUMMARY OF THE INVENTION

Accordingly, the inventor has conceived and reduced to practice, in a preferred embodiment of the invention, an enhanced system and method for automatically deploying boat fenders.

According to a preferred embodiment of the invention, a system for automatically deploying boat fenders, comprising a fender basket configured to contain a plurality of boat fenders and further configured to lower a plurality of boat fenders into a body of water; a plurality of boat fenders, wherein at least a portion of the plurality of boat fenders are attached to a plurality of lines, at least a portion of the plurality of lines being coupled to a winch, the winch being coupled to a motor; and a basket controller comprising a plurality of software programming instructions stored in a memory and operating on a processor of a computing device, and configured to direct the operation of a motor, is disclosed.

BRIEF DESCRIPTION OF THE DRAWING FIGURES

The accompanying drawings illustrate several embodiments of the invention and, together with the description, serve to explain the principles of the invention according to the embodiments. It will be appreciated by one skilled in the art that the particular embodiments illustrated in the drawings are merely exemplary, and are not to be considered as limiting of the scope of the invention or the claims herein in any way.

DETAILED DESCRIPTION

Figure 1:
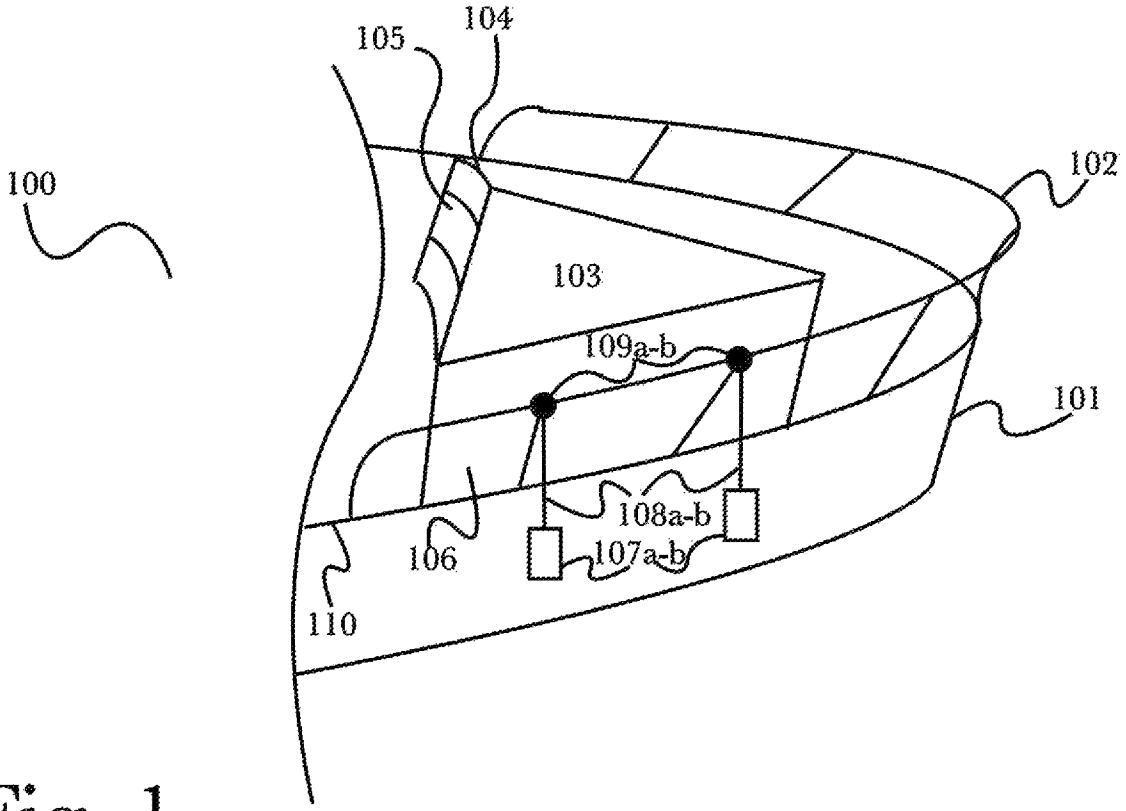
FIG. 1 is an illustration of a typical pleasure boat, illustrating the use of railings and fenders.

The inventor has conceived, and reduced to practice, in a preferred embodiment of the invention, an enhanced system and method for automatically deploying boat fenders.

One or more different inventions may be described in the present application. Further, for one or more of the inventions described herein, numerous alternative embodiments may be described; it should be appreciated that these are presented for illustrative purposes only and are not limiting of the inventions contained herein or the claims presented herein in any way. One or more of the inventions may be widely applicable to numerous embodiments, as may be readily apparent from the disclosure. In general, embodiments are described in sufficient detail to enable those skilled in the art to practice one or more of the inventions, and it should be appreciated that other embodiments may be utilized and that structural, logical, software, electrical and other changes may be made without departing from the scope of the particular inventions. Accordingly, one skilled in the art will recognize that one or more of the inventions may be practiced with various modifications and alterations. Particular features of one or more of the inventions described herein may be described with reference to one or more particular embodiments or figures that form a part of the present disclosure, and in which are shown, by way of illustration, specific embodiments of one or more of the inventions. It should be appreciated, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more communication means or intermediaries, logical or physical.

A description of an embodiment with several components in communication with each other does not imply that all such components are required. To the contrary, a variety of optional components may be described to illustrate a wide variety of possible embodiments of one or more of the inventions and in order to more fully illustrate one or more aspects of the inventions. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred. Also, steps are generally described once per embodiment, but this does not mean they must occur once, or that they may only occur once each time a process, method, or algorithm is carried out or executed. Some steps may be omitted in some embodiments or some occurrences, or some steps may be executed more than once in a given embodiment or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments of one or more of the inventions need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of embodiments of the present invention in which, for example, functions may be executed out of order from that shown or discussed, including substantially concurrently or in reverse order, depending on the functionality involved, as would be understood by those having ordinary skill in the art.

Detailed Description of Exemplary Embodiments

FIG. 1 shows a typical pleasure boat 100 (approximately 15-35' long), with a railing 102 around the front section. Two fenders 107*a* and 107*b* hang down from the railing, positioned with lines 108*a-b* held in place with knots 109*a-b* on railing 102 to protect the boat from damage when the boat makes contact with the dock. During a cruise, the fenders need to be lifted up or stowed securely, as otherwise the wave action could easily rip them off or they may cause damage to the boat. Access to the railing for purposes of deploying and positioning fenders from the top of the boat may be difficult and hazardous, because in many cases it is available from a narrow ledge 106 via a step 110 or from the top of the boat prow 103 using window gate 105 in windshield 104, that window gate being heavy and difficult to open. Boat prow 103 is often of a slick material such as fiberglass coated, in some cases, with marine paint. Further the surface may, in many cases, be wet with, in some cases, dust mixed in, and/or the boat may be rocking and jerking in wind and waves, making it even more slippery and more hazardous. From the railing a person must then lean over to deploy and position the fenders.

The system and method disclosed herein uses a lift system for fenders, with baskets providing secure stowage for fenders when not in use. Additionally, an application on a smartphone may remind the crew to lower the fenders when approaching the dock, and possibly, based on previous dockings, a reminder for a mark on the line where to cleat or fast cleat the line, so the fender has the appropriate height for that dock. In some cases the application may be a reminder or in other cases the application actually doing the operation as the baskets are motorized in those cases. In most cases the fender is positioned at the same height while docking, but in some situations different heights are necessary.

In some cases, a basket for stowing a fender is used, that is sometimes attached to a part of a vessel or boat, and the basket has an opening for threading through a line (in some cases with a pulley), said line attached to a fender, said line operable by a user to pull up the fender into said basket through a second opening at the bottom of said basket. Typically the basket has at least one moveable, hinged section, said section formed in such a manner, that when pulling up the fender to the top, said movable section is clamping in on said fender and securing it. In some cases the basket and the moveable section can be made of a rigid material such as a metal, suitable for marine use. In other cases a majority of the parts are made from a soft plastic material suitable for molding. In yet other cases, the parts of the basket are made of a combination of rigid metal parts and soft plastic materials. Additionally, in some cases a fast cleat is provided to secure said line in at least two positions, one of which has the fender full retracted and at least one other having the fender deployed, and wherein said fast cleat is mounted in an easy to reach location on said vessel. Further, an application for use on smart phone can be provided, and the application has access to a third party map system. The application has also access to the GPS system of the smartphone. When approaching a landing site the application can be used by a user to add locations used by the vessel for landing, and said user can enter a mark representing the height of the fenders deployed. In some cases, the application will display and or make heard a reminder to deploy at least one fender, and that display will include the previously stored height mark for deploying said fender. In yet other cases, the basket for stowing a fender will have a cleat or auto cleat to allow the line to be secured at any position. In some of these cases the cleat is attached to or near the basket. Furthermore, in some cases the cleat can be released with a controlled jerking of the line. In some cases the line may be routed inside the basket and exit from the same opening as the fender.

In additional cases, the system and method disclosed herein uses wired or wireless communication, such as, for example, Bluetooth, to control automatic deployment and retraction of boat fenders. The mechanism can be powered by solar or the boat direct current (DC).

In some other cases, a system may comprise a basket for lowering one or multiple boat fenders, with the fender attached to a line that is coupled to a winch that is coupled to a motor, with the motor controlled by a controller that may be activated via wireless control signals. Power for the motor may be drawn from a battery, which may be the onboard power supply or, alternatively, may be separately charged from a solar panel. Alternatively, each basket may have an individual controller, battery, and solar panel, not requiring any wiring between the units.

In some cases, the system and its methods enable these fenders to be controlled from a mobile computing device, such as a smartphone or tablet, both which should be considered equivalent for all purposes here. Additionally, in some cases, based on repeated visits, the fenders can deploy automatically based on the GPS location of the boat and the fact that its trajectory leads the boat to a landing slip, berth, dock etc.

In further cases, a smartphone with an application ("app") may be used to control one or more of the basket controllers and a multitude of automatic baskets. The app can also control baskets based on previous programming, without requiring user interaction, and, additionally, based on distance to a landing site derived from GPS data and map data, can prompt the user for an action and can memorize that action for future use. This app may include a dedicated control panel to wirelessly control one or more controllers of baskets, using Bluetooth or Wi-Fi etc. as a wireless protocol.

In some cases, rather than a smart phone or tablet, an onboard navigation system or some other computerized boat system may be upgraded or extended to add the control functionality. This could be done via wired or wireless control of motorized buckets. For purposes, here, they all should be considered equivalent. For example, a boat may have a GPS enabled computing device, and it may be used to provide the control functionality described herein. Similarly, boat navigation systems and advanced systems such as fish finding sonar systems could be extended by incorporation of the control functionality described herein; in effect, any digital processing device incorporated in or used in conjunction with a boat could be used as the platform for incorporation of control functionality described herein for operating the fender retrieval system.

In some cases, rather than mounting a basket to the railing, a basket type tube could be integrated into the hull of a boat, similar to torpedo tube with or without an outer door protecting when not in use. It can be designed outside the displacement section of the boat hull, thus eliminating complicated locks on the inside, not requiring water proofing the interfaces. For purposes herein, it would be considered essentially equivalent.

Figure 2:
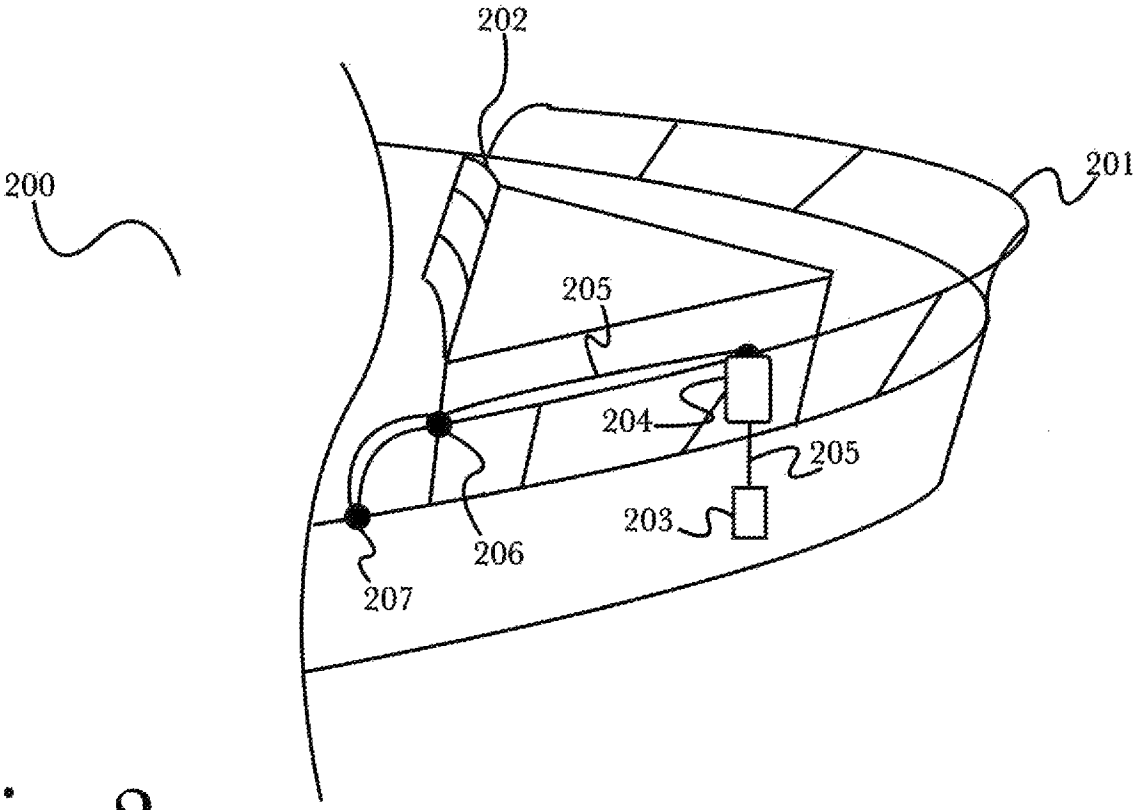
FIG. 2 shows an exemplary overview of an installation of manually-deployed boat fenders, according to a preferred embodiment of the invention.

FIG. 2 shows an overview of the installation 200 of manually deployed fenders, according to one aspect of the system and method disclosed herein. Windshield 202 has a center partition that can be folded away to reach the boat prow. Attached to railing 201 is fender basket 204, which holds fender 203 when said fender is not in use (only one fender and basket shown, for purposes of clarity and simplicity; however, typically, multiple fenders are used). A rope, cable, or similar flexible line 205 (for purposes of this system, rope, cable, and line all shall be considered equivalent, irrespective of material(s) made of) runs from a position above the basket, across pulley 206, to cleat 207, which cleat is used by the operator to secure the line in position, which position is often predetermined and marked on said line. Thus the fender may be hauled up into the basket when the boat is taken out on the water and deployed (lowered) when the boat approaches a dock.

Figure 3:
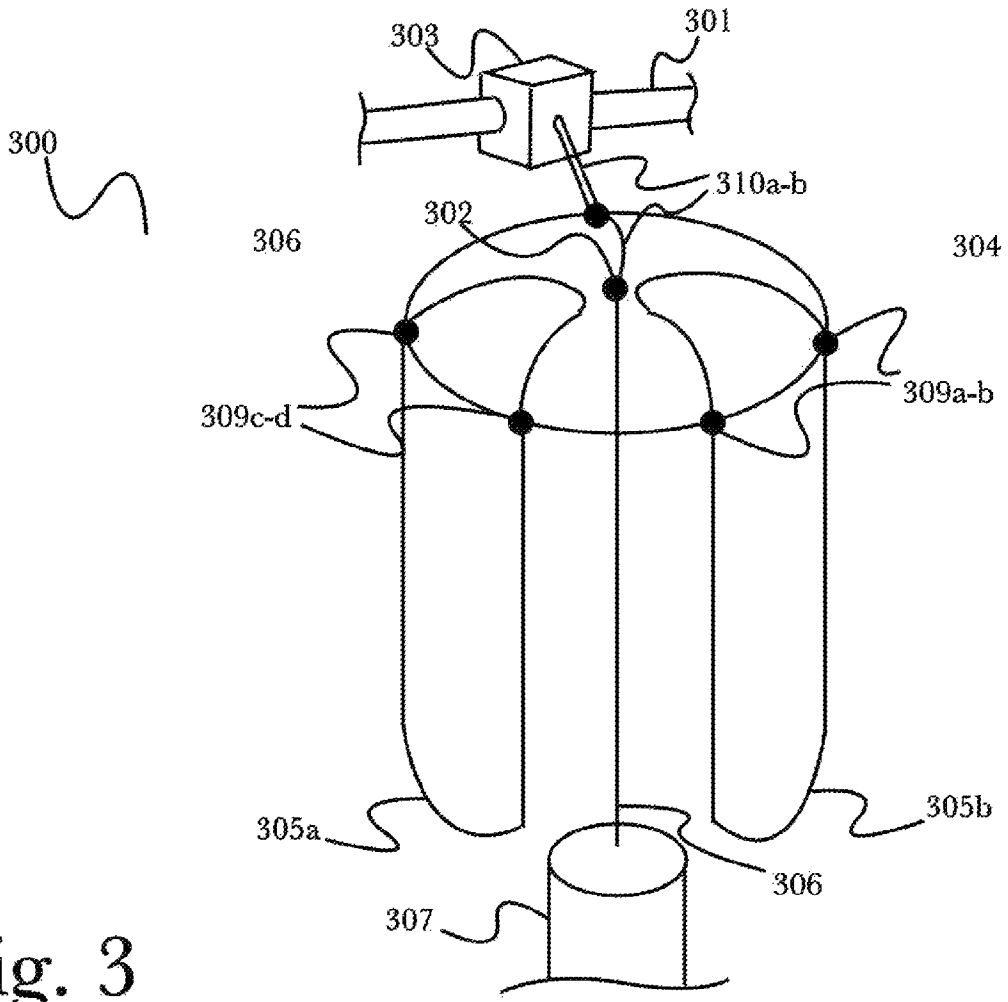
FIG. 3 shows a detailed view of an exemplary assembly of a fender basket, according to a preferred embodiment of the invention.

FIG. 3 shows a detailed view of exemplary assembly 300 of basket 204 from FIG. 2 above, according to one aspect of the system and method disclosed herein. Attached by clamp 303 to railing 301 is a holder 310*a* that holds ring 304, which in turn holds the basket, plus a pulley (or ring) 302, via holder 310*b*, said pulley that is used to redirect line 306 when it comes up. In this example two sections (or segments) 305*a-b* are hinged at the top with, respectively, hinges 309*c-d* and 309*a-b*. The hinges are attached to ring 304. When fender 307 is pulled up on line 306 across pulley 302, the tips of hooks cause the extensions at the bottoms of sections 305*a-b* to clamp the fender in place, as the hinge lever action causes the bottom ends of sections 305*a-b* to pull in. In some cases, basket extension 305*a-b* may be made of plastic; in other cases, they may be made of some suitable material resistant to corrosion, such as, for example, chrome-plated wire. In yet other cases, the bottom end maybe be flaring, as shown in 305*a*, allowing for an easier insertion of the fender 307, in other cases it may be hooked inward, as shown in 305*b*, providing additional securing of fender 307 when stowed. Also, in additional cases, rather than two sections, three, four or more sections maybe used.

Figure 4:
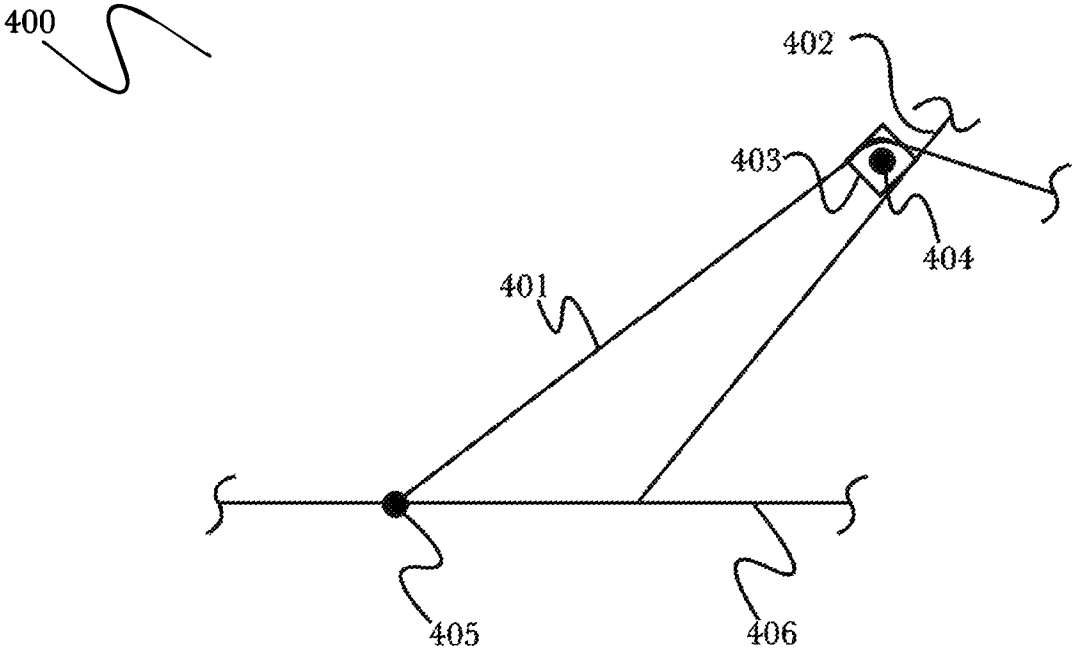
FIG. 4 shows an exemplary pulley assembly according to an embodiment of the invention.

FIG. 4 shows an exemplary pulley assembly 400, according to one aspect of the system and method disclosed herein. Line 402 comes in from the basket on railing 401 and goes through pulley wheel 404, which is attached to pulley block 403. At the pulley, line 402 is redirected to cleat 405. In some cases, double or triple pulleys maybe used as often more than one fender is used. Also, instead of regular cleats, fast cleats and multi-line fast cleats maybe used for easier use.

Figure 5:
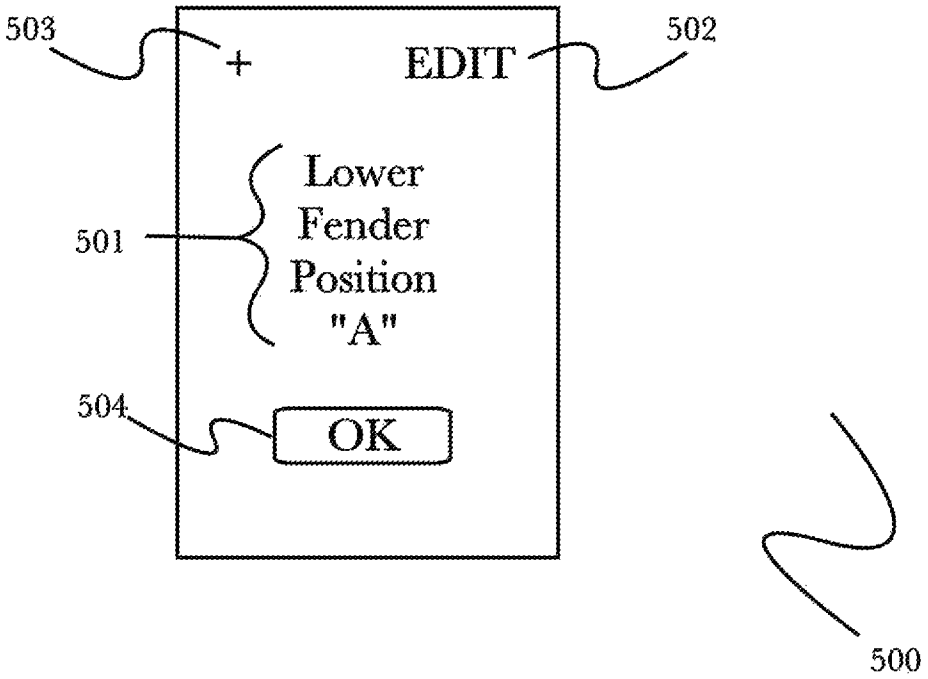
FIG. 5 shows an exemplary popup screen of a reminder software application according to an embodiment of the invention.

FIG. 5 shows a popup screen of reminder app 500. It uses high-accuracy marine maps such as, for example those provided by NAVIONICS™, to determine whether the boat is about to dock, and notifies the user with message 501 (and in some cases an acoustic alert) of the position to which the lines need to be lowered. Also shown are buttons to add new positions "+"503 based on current GPS location, to set the height, and to "edit" 502 for modifying an existing height, for example, or delete a previously stored location. Further, an OK button 504 enables the operator to confirm and/or close the alert and mute an acoustic signal.

Figure 6:
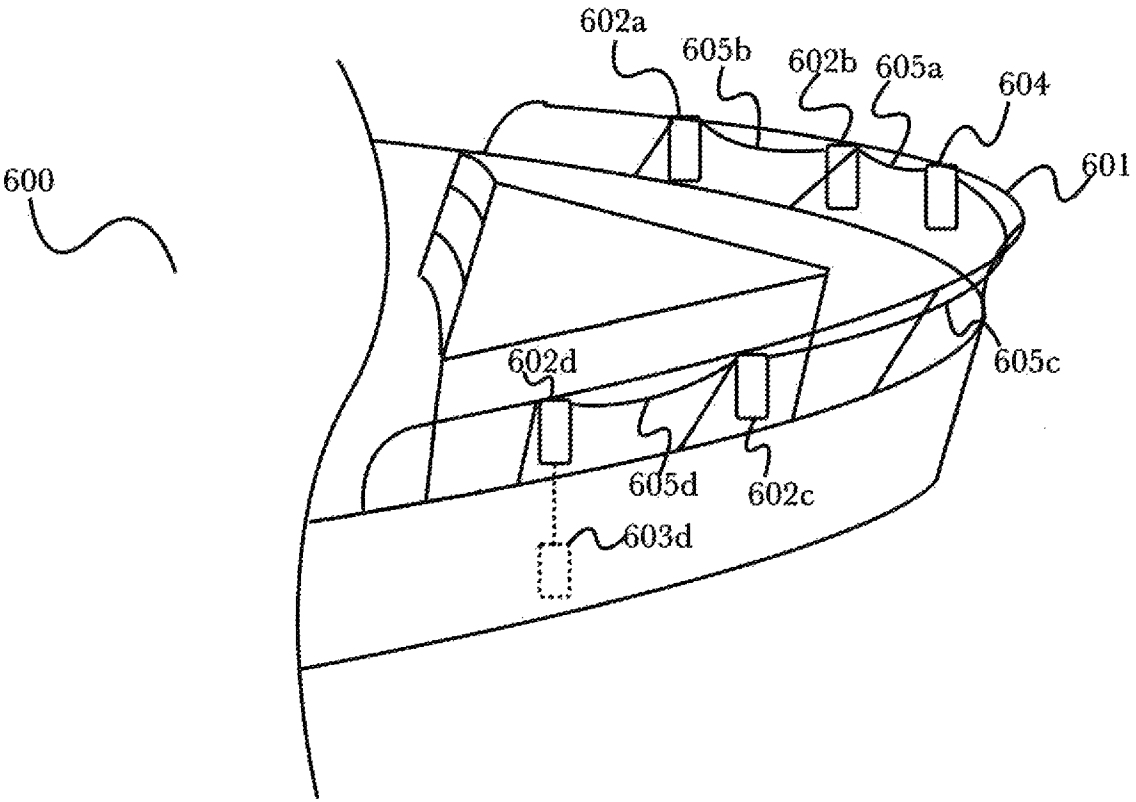
FIG. 6 shows an overview of an exemplary boat prow, according to an embodiment of the invention.

FIG. 6 shows an overview of boat prow 600, according to one aspect of the system and method disclosed herein. Four baskets 602*a-d* are attached to railing 601. Wires 605*a-d* connect the baskets to solar panel 604, which is also attached to railing 601. Beneath solar panel 604, and connected to it, are a controller and a battery (not shown here). Fender 603*d* (only one fender shown here, for clarity and simplicity) is shown as it may be deployed, with multiple dotted lines to indicate that the fender may be deployed at any of multiple heights. It is clear that a boat may carry more than four basket-fender units, and they are typically deployed all along the side of the boat, from prow to stern; however, for clarity and simplicity, only four are shown as positioned here.

Figure 7:
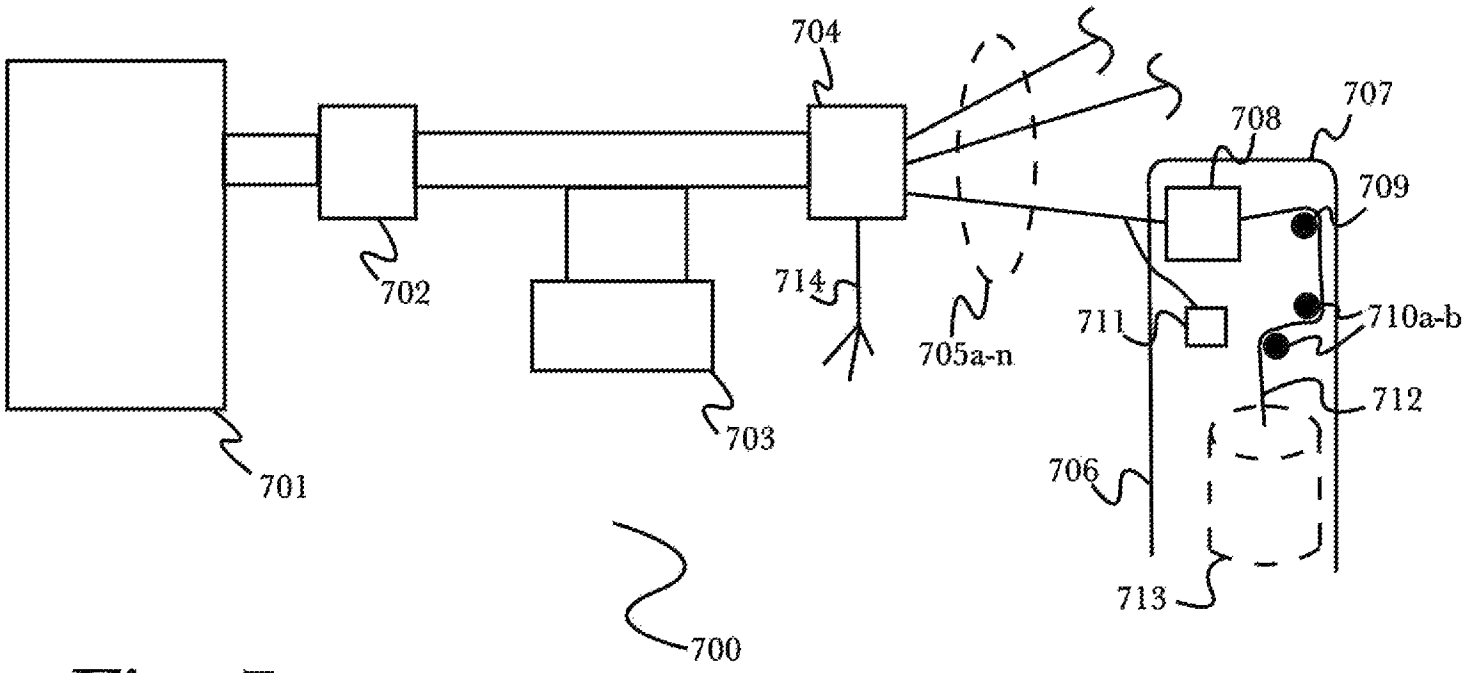
FIG. 7 shows a detailed view of an exemplary solar panel assembly, according to an embodiment of the invention.

With reference to solar panel 604, FIG. 7 shows a detailed view of solar panel assembly 700, according to one aspect of the system and method disclosed herein. Panel 701 connects to charge control unit 702. Unit 702 is an existing commercial product that is readily available. Often unit 702 may be integrated into a junction box at the rear of panel 701. Battery 703 may be any of various types of battery, such as, for example, lead-acid, lead-acid gel, lithium, lithium ion, LiFePO4, NiCd, NiMh or any other suitable type, depending on which is best and most suitable for its situation. System controller 704 has an antenna 714 and wires 705*a-n* leading to the baskets. Exemplary basket 706, connected to box 704 via wire 705*x*, contains fender 713, shown in a dotted line to indicate that it is not externally visible. Line 712 goes over two pulleys 710*a-b* to winch 709 that is attached to motor 708. Casing 707 protects assembly elements, including 707, 709, 710*a-b* 711, and 712 against water, collision, injury of persons nearby, etc. When fender 713 is retracted, switch 711 signals to controller 704 when the fender is fully retracted. In some cases, a smaller solar cell and smaller controller may be mounted on the top of the basket, omitting the need for wires such as wire 705*x*. Typically wire 705*x* uses a four-lead wire, that is, two for the motor and two for the switch. In other cases, instead of using a solar panel to power the system, controller 704 may be powered from the boat's power supply. In yet other cases, the assembly contained in case 707 may be installed centrally and the line may be pulled as shown in FIG. 2 to a location with multiple motorized winches. Also, in lieu of using a mechanical switch 711, optical means, both transmissive and reflective, may be used, or simply a change in current of the motor that the controller can detect and use as an indicator of too much resistance, either at the end or if fender is caught somehow. All these exemplary variations, and other, similar variations, shall not depart from the spirit of the system and method disclosed herein.

Figure 8:
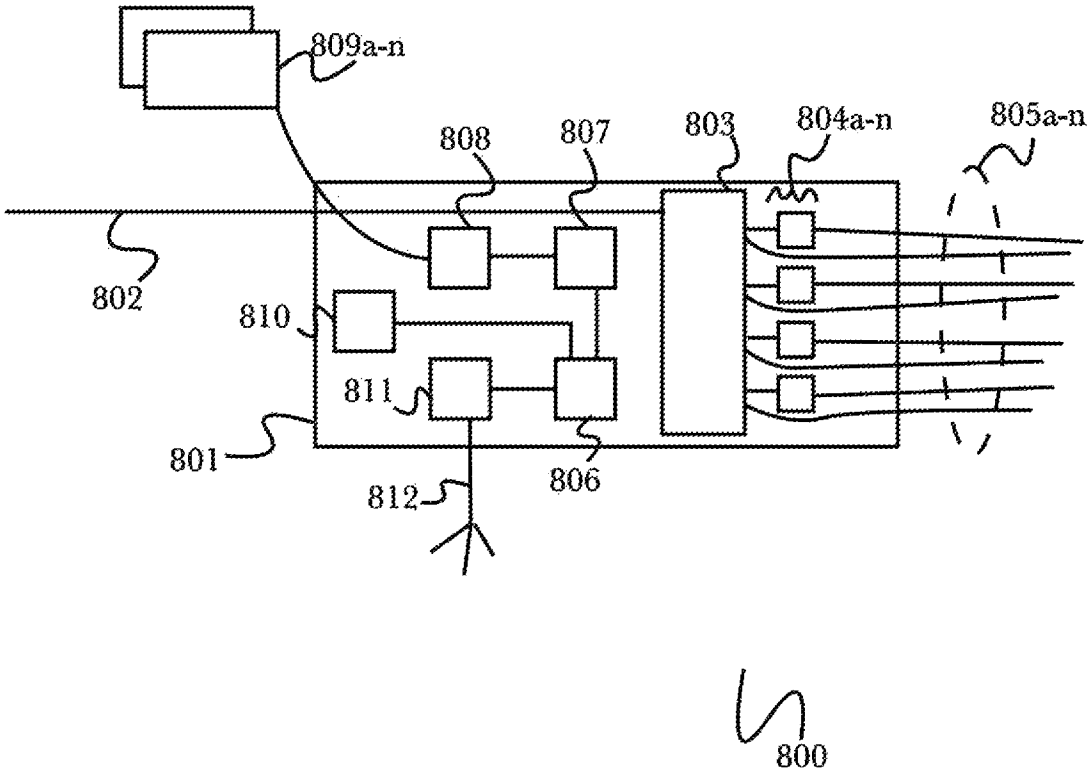
FIG. 8 shows a detailed view of an exemplary solar controller, according to an embodiment of the invention.

With reference to controller 704, FIG. 8 shows a more detailed view 800 of controller 704, according to one aspect of the system and method disclosed herein. Power supply input 802 may come from a local battery, a shipboard battery, or some other power source. Controller 801 has a microprocessor 806, typically a system on a chip with memory 807 and nonvolatile memory 808, which nonvolatile memory contains software 809*a-n*, including an operating system as well as actual commands for the system. Input/output unit 810 may pair the radio 811 with a smart phone. Radio 811 connects to microcontroller 806 as well as to antenna 812. The connection between radio 811 and a smart phone may be via, for example, BlueTooth, Wi-Fi, or both as needed. Power switch unit 803 distributes power to all these devices, as well as controlling output power through switches 804*a-n*, thus enabling the winches to extend lines to extend or retract the fenders. Switch unit 803 also has the input sensors for the switches in the baskets, such as, for example, switch 711 inside casing 707, described above in the discussion of FIG. 7, for extending or retracting the fenders.

Figure 9:
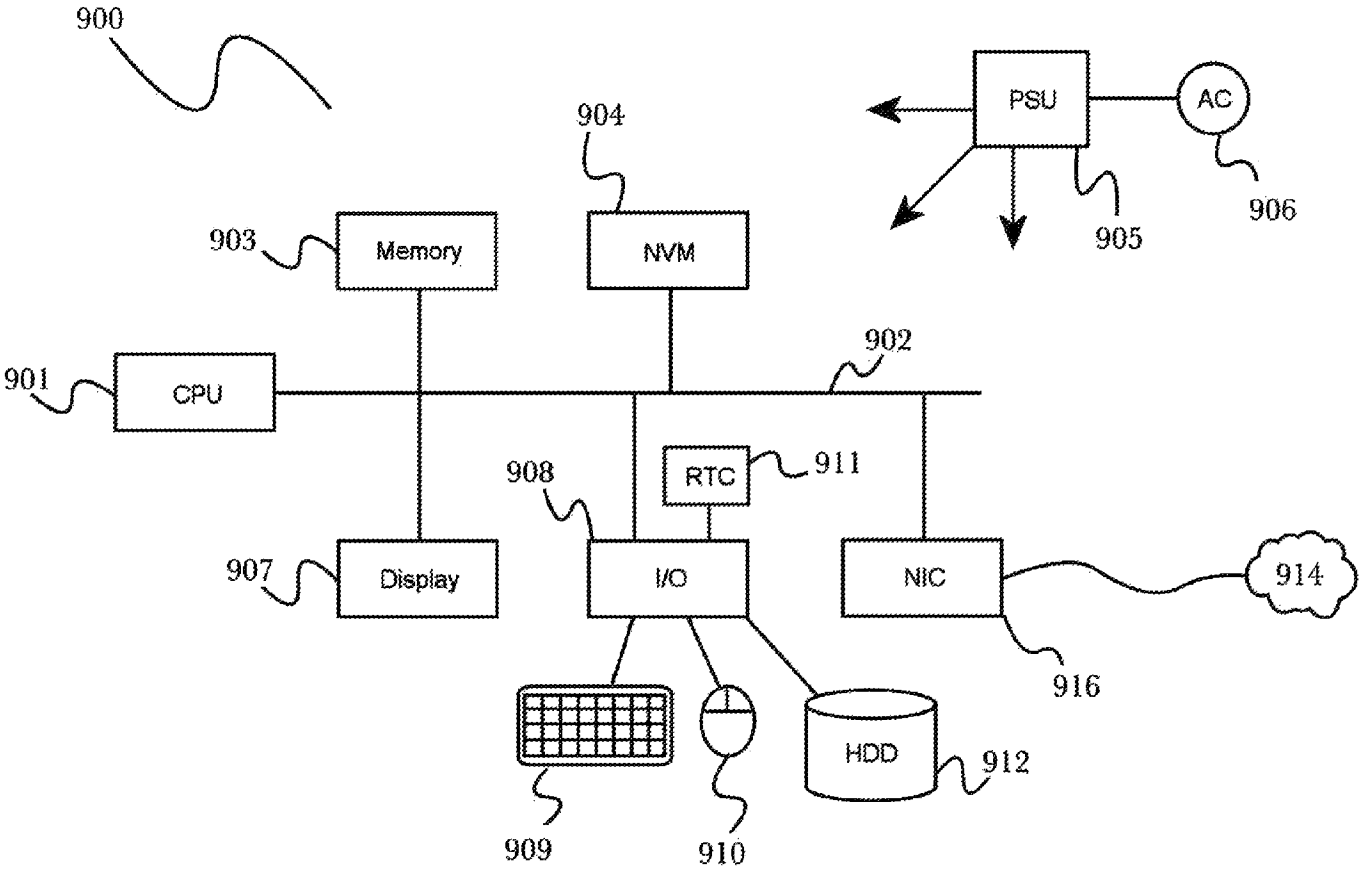
FIG. 9 is a block diagram illustrating an exemplary hardware architecture of a computing device used in an embodiment of the invention.

FIG. 9 shows an exemplary overview of a computer system 900 as may be used in the system and method disclosed herein. It is exemplary of any computer that may execute code to process data. Various modifications and changes may be made to computer system 900 without departing from the broader spirit and scope of the system and method disclosed herein. CPU 901 is connected to bus 902, to which bus is also connected memory 903, nonvolatile memory 904, display 907, I/O unit 908, and network interface card (NIC) 916. I/O unit 908 may, typically, be connected to keyboard 909, pointing device 910, hard disk 912, and real-time clock 911. NIC 916 connects to network 914, which may be the Internet or a local network, which local network may or may not have connections to the Internet. Also shown as part of system 900 is power supply unit 905 connected, in this example, to ac supply 906. Not shown are batteries that could be present, and many other devices and modifications that are well known but are not applicable to the specific novel functions of the current system and method disclosed herein. Also present, but not shown in detail, as part of I/O unit 908, for example, will local wireless connections, such as BLUETOOTH™, WiFi, ZIGBEE™ etc. Further, in many cases, a GPS receiver is used to provide for location services.

Figure 10:
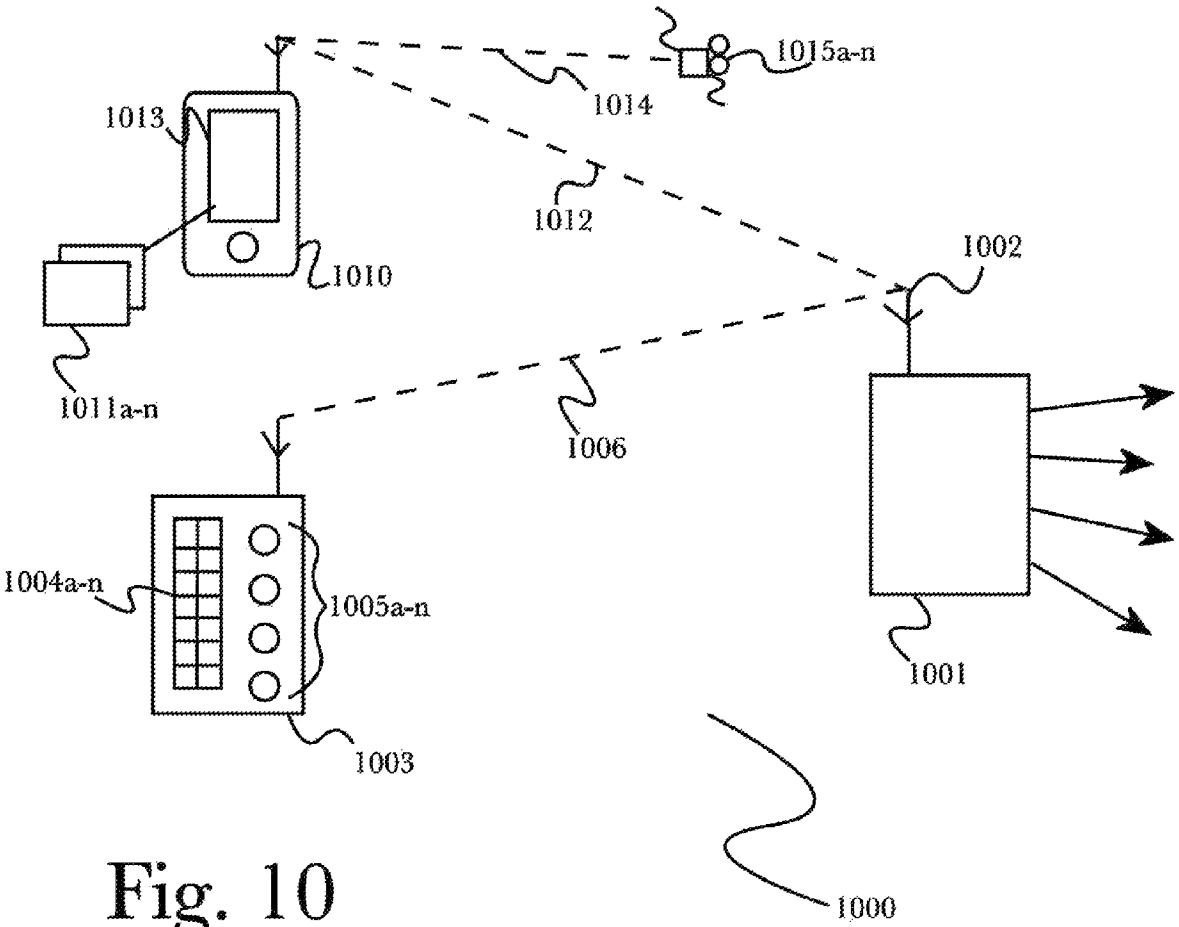
FIG. 10 shows an exemplary overview of a system for operating automatically-deployed boat fenders, according to a preferred embodiment of the invention.

FIG. 10 shows an exemplary overview of system 1000, according to one aspect of the system and method disclosed herein. Controller 1001, which is functionally equivalent to controller 704, described above in the discussion of FIG. 7, has an antenna 1002 and also the software and other components required to control fender deployment operations as previously described. Controller 1001 may connect to a dedicated control unit 1003, which unit has a set of buttons 1004*a-n*, such as, for example, two rows of buttons as shown here. Each button has a separate assigned function, controlling the raising or lowering of one fender. General controls 1005*a-n* may, for example, indicate the status of certain system functions, such as, for example, power state and the state of connectivity to wireless network 1006, which network may use BLUETOOTH™, WiFi, or some other, similar connection protocol. Controls 1005*a-n* may also control functions such as raising or lowering all fenders or certain combinations of fenders, such as all fenders on one side, for example. As an alternative control unit, the system may use a smart phone, such as, for example, phone 1010, on whose touch screen 1013 the user can control the functions of specialized software 1011*a-n*. Software 1011*a-n* is specific to system 1000 and typically may be downloaded from an app store supplying software for the particular model of phone 1010. Software 1011*a-n* can communicate with controller 1001 via connection 1012, which, may be BLUETOOTH™, WiFi, or some other, similar connection protocol. Connection 1014 enables phone 1010 to communicate with geo-positioning satellites 1015*a-n*, using any of various global positioning systems supported by phone 1010 and available currently or in the future.

Figure 11:
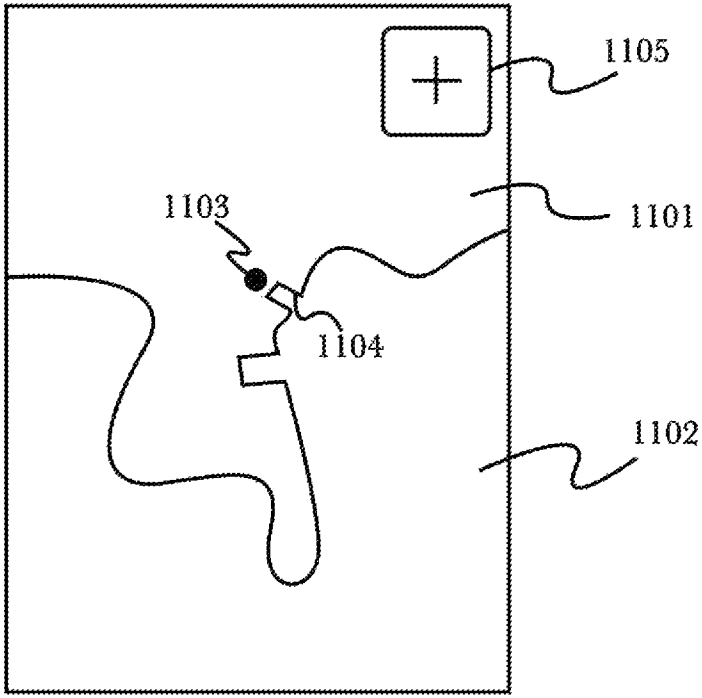
FIG. 11 shows a view of an exemplary system application screen depicting a boat approaching a dock in a harbor.

FIG. 11 shows a view of an exemplary system application screen 1100 depicting a boat approaching a dock in a harbor, according to one aspect of the system and method disclosed herein. In this example, a boat 1103 is in water 1101, approaching dock 1104, which dock extends from land 1102. When the boat comes within a certain predetermined distance from the dock, an indicator 1105 appears on application screen 1100. The boat's position, in this example, is determined by high-accuracy navigational mapping software (not shown here) as mentioned in the description of FIG. 5. Indicator 1105 enables a user to open addition application menus with additional functionality.

Figure 12:
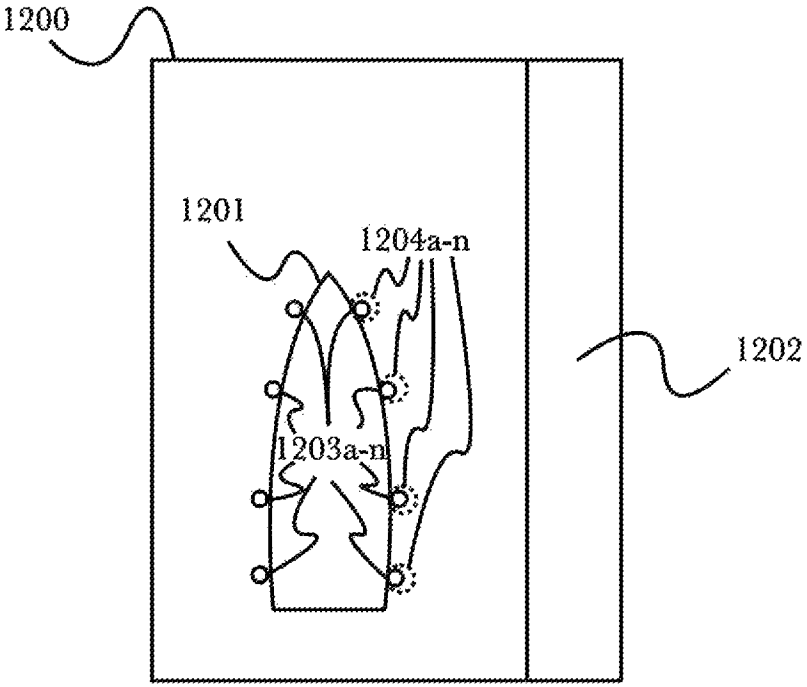
FIG. 12 shows an exemplary application screen illustrating additional application functionality accessible through an indicator.

FIG. 12 shows an application screen 1200 that is exemplary of additional application functionality accessible through indicator 1105, according to one aspect of the system and method disclosed herein. In this example, boat 1201, viewed from the top, approaches dock 1202. Screen 1200 shows all boat fenders 1204*a-n*, of which in this example there are eight. Those fenders on the side approaching dock 1202 are indicated, for example, by halo buttons, that is, buttons showing a halo around the fender indicating a possible user interaction. Screen 1200 may also contain an additional button (not shown here) that enables a user to control multiple fenders, such as, for example, all fenders together, all fenders on the side of the boat approaching the dock, all front fenders, all rear fenders, etc.

Figure 13:
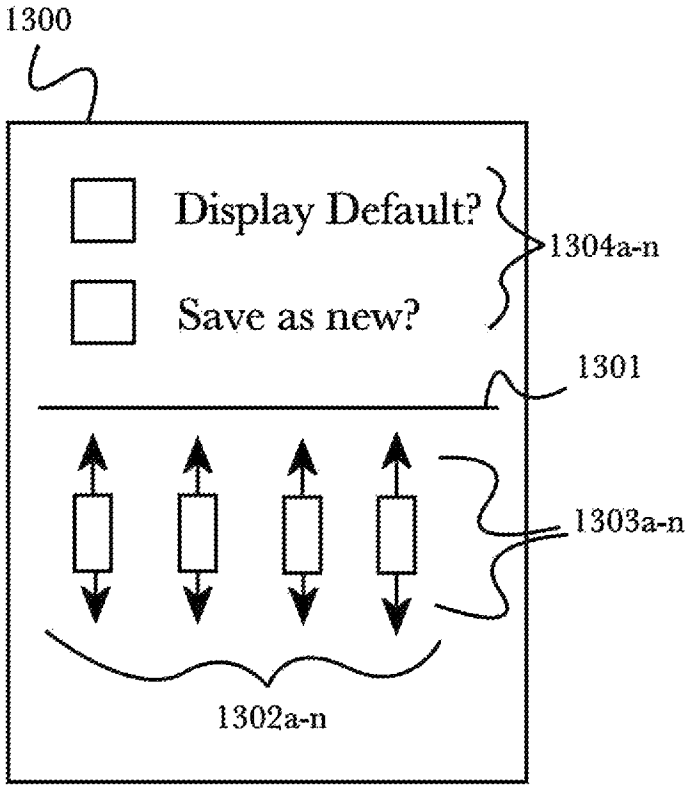
FIG. 13 shows an exemplary application screen that may open when a user has deployed boat fenders.

FIG. 13 shows an exemplary application screen 1300 that may open when a user has deployed boat fenders as described in the discussion of FIG. 12, according to one aspect of the system and method disclosed herein. Represented on screen 1300 is one side 1301 of the boat, with fenders 1302*a-n*. Above and below fenders 1302*a-n* are arrows 1303*a-n*, indicating fender movement up or down. Buttons 1304*a-n* give a user control of general functions, such as, for example, deploying all fenders to a default position or saving a manually controlled position as a new default position. Individual fender positions may be manually controlled by pressing any of arrows 1303*a-n* to adjust any one fender up or down as desired. When the fenders are all adjusted for a certain dock, the user could then save the fender positioning as a new default for this location, so the next time the user goes to approach this particular dock, the fenders can be deployed automatically to the saved positions when the boat comes within a certain predetermined distance from the dock.

Various embodiments of the present disclosure may be implemented in computer hardware, firmware, software, and/or combinations thereof. Methods of the present disclosure can be implemented via a computer program instructions stored on one or more non-transitory computer-readable storage devices for execution by a processor. Likewise, various processes (or portions thereof) of the present disclosure can be performed by a processor executing computer program instructions. Embodiments of the present disclosure may be implemented via one or more computer programs that are executable on a computer system including at least one processor coupled to receive data and instructions from, and to transmit data and instructions to, a data storage system, at least one input device, and at least one output device. Each computer program can be implemented in any suitable manner, including via a high-level procedural or object-oriented programming language and/or via assembly or machine language. Systems of the present disclosure may include, by way of example, both general and special purpose microprocessors which may retrieve instructions and data to and from various types of volatile and/or non-volatile memory. Computer systems operating in conjunction with the embodiments of the present disclosure may include one or more mass storage devices for storing data files, which may include: magnetic disks, such as internal hard disks and removable disks; magneto-optical disks; and optical disks. Storage devices suitable for tangibly embodying computer program instructions and data (also called the "non-transitory computer-readable storage media") include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits) and other forms of hardware.

In some cases, a basket for stowing a fender is used, that is attached to a fixed part of a vessel or boat, and the basket has an opening for threading through a line (in some cases with a pulley), said line attached to a fender, said line operable by a user to pull up the fender into said basket through a second opening at the bottom of said basket. Typically the basket has at least one moveable, hinged section, said section formed in such a manner, that when pulling up the fender to the top, said movable section is clamping in on said fender and securing it. In some cases the basket and the moveable section can be made of a rigid material such as a metal, suitable for marine use. In other cases a majority of the parts are made from a soft plastic material suitable for molding. In yet other cases, the parts of the basket are made of a combination of rigid metal parts and soft plastic materials. Additionally, in some cases a fast cleat is provided to secure said line in at least two positions, one of which has the fender full retracted and at least one other having the fender deployed, and wherein said fast cleat is mounted in an easy to reach location on said vessel. Further, an application for use on smart phone can be provided, and the application has access to a third party map system. The application has also access to the GPS system of the smartphone. When approaching a landing site the application can be used by a user to add locations used by the vessel for landing, and said user can enter a mark representing the height of the fenders deployed. In some cases, the application will display and or make heard a reminder to deploy at least one fender, and that display will include the previously stored height mark for deploying said fender. In yet other cases, the basket for stowing a fender will have a cleat or auto cleat to allow the line to be secured at any position. In some of these cases the cleat is attached to or near the basket. Furthermore, in some cases the cleat can be released with a controlled jerking of the line. For purposes, here, they all should be considered equivalent a GPS enabled computing device. In some cases the line may be routed inside the basket and exit from the same opening as the fender.

In additional cases, the basket for lower fenders has a moveable bar across the opening, and this bar, which can move along the cylindrical axis of the basket and is pulled up alongside the fender into the basket, has a small opening for guiding the line, as well as additional openings or features for guiding itself up and down the basket. Further, an external force can make the basket swing back into the hull line, counteracting at least a spring, connected to the hinge, that moves the basket outside the hull line for normal operations. In some cases, the line may be couple to a motor-driven winch, with the motor controlled by wired or wireless signals.

In additional cases, in a system with one or more baskets for lowering one or more fenders attached to a line, each basket may be mounted with one or more hinges so the basket can swing out from the boat's outline, for easy deployment of a fender. Further, each basket may be controlled for the swing-out with a lever attached to the boat and used to initiate and stop or reverse the swing-out action of the basket. This lever may be a hinged arm and may be operated manually or by a motor. In some cases, the basket may be mounted substantially within the boat's outline and angled so the fender may be lowered through an opening in the railing over the edge of the boat's board. The basket, in such cases, may also have an additional slide extension at the bottom opening to extension guide the fender over the edge of the boat. The basket may, in such cases, extend out through an opening in the railing to facilitate easier deployment of the fender, which deployment may be accomplished either manually or with the help of a motor, and the swing-out may be achieved, with the help of an additional motor.

In some cases, rather than mounting a basket to the railing, a basket type tube could be integrated into the hull of a boat, similar to torpedo tube with an outer door protecting when not in use. It can be designed outside the displacement section of the boat hull, thus eliminating complicated locks on the inside, not requiring water proofing the interfaces. For purposes herein, it should be considered essentially equivalent.

In some other cases, a system may comprise a basket for lowering one or multiple boat fenders, with the fender attached to a line that is coupled to a winch that is coupled to a motor, with the motor controlled by a controller that may be activated via wireless control signals. Power for the motor may be drawn from a battery, which may be the onboard power supply or, alternatively, may be separately charged from a solar panel. Alternatively, each basket may have an individual controller, battery, and solar panel, not requiring any wiring between the units.

In some cases, the system and its methods enable these fenders to be controlled from a mobile computing device, such as a smartphone or tablet, both of which should be considered equivalent for all purposes here. Additionally, in some cases, based on repeated visits, the fenders can deploy automatically based on the GPS location of the boat and the fact that its trajectory leads the boat to a landing slip, berth, etc.

In further cases, a smartphone with an app may be used to control one or more of the basket controllers and a multitude of automatic baskets. The app (or more generically referred to as software/SW) can also control baskets based on previous programming, without requiring user interaction, and, additionally, based on distance to a landing site derived from GPS data and map data, can prompt the user for an action and can memorize that action for future use. This app may include a dedicated control panel to wirelessly control one or more controllers of baskets, using Bluetooth or Wi-Fi etc. as a wireless protocol.

In some cases, rather than a smart phone or tablet, an onboard navigation system may be upgraded or extended to add the control functionality. This could be done via wired or wireless control of motorized buckets.

The skilled person will be aware of a range of possible modifications of the various embodiments described above. Accordingly, the present invention is defined by the claims and their equivalents.

What is claimed is:

1. A system for automatically deploying a boat fender to protect a boat's hull, comprising:

a fender basket adapted to contain a boat fender in a stowed position and to lower the boat fender from the stowed position into a deployed position capable of protecting the boat's hull;

wherein the boat fender is attached to a line, the line being coupled to a winch, the winch being coupled to a motor; and a system controller comprising a plurality of software programming instructions stored in a memory and operating on a processor of a computing device;

wherein the system controller directs operation of the motor; and wherein the system controller receives GPS location information pertaining to the boat, and prompts a user for input to raise or lower the boat fender, the prompt being based at least in part on the GPS location information; and wherein the system controller, based on the GPS location information, directs the motor to lower the boat fender to the deployed position when the boat arrives at a predetermined distance from a dock.

2. The system of claim 1, wherein the computing device is a smartphone.

3. The system of claim 1, wherein the computing device is a tablet computing device.

4. The system of claim 1, wherein the system controller is installed and operates onboard a boat.

5. The system of claim 1, wherein the system controller directs the operation of a plurality of fender baskets.

6. The system of claim 5, wherein the system controller directs the operation of the plurality of fender baskets automatically without user interaction, the operation being directed based at least in part on a plurality of stored operation instructions.

7. The system of claim 1, wherein the location information further comprises at least a plurality of map data.

8. The system of claim 1, further comprising a user interface application comprising a plurality of programming instructions stored in a memory and operating on a processor of a mobile computing device; wherein the user interface application directs the operation of the motor.

9. The system of claim 8, wherein the user interface application directs the operation of a plurality of retractable fenders.

* * * * *